US005862912A

United States Patent [19]

Schelhorn

[11] Patent Number: 5,862,912

[45] Date of Patent: Jan. 26, 1999

[54] PACKAGE OF BUILDING-PANEL PRODUCTS

[75] Inventor: Jean E. Schelhorn, Granville, Ohio

[73] Assignee: Owens Corning Fiberglas Technology, Inc., Summit, Ill.

[21] Appl. No.: 847,422

[22] Filed: Apr. 24, 1997

[51] Int. Cl.[6] ..... B65D 85/46

[52] U.S. Cl. ..... 206/321; 206/499

[58] Field of Search ..... 206/321, 325, 206/451, 459.5, 499; 53/157

[56] References Cited

U.S. PATENT DOCUMENTS

| | | | |
|---|---|---|---|
| 1,929,161 | 10/1933 | Coffin | 206/451 |
| 2,081,754 | 5/1937 | Lockhart . | |
| 2,102,089 | 12/1937 | Perrin . | |
| 2,271,470 | 1/1942 | Youngfelt et al. . | |
| 2,770,359 | 11/1956 | White et al. . | |
| 3,332,551 | 7/1967 | Peterson . | |
| 3,413,689 | 12/1968 | Powell et al. | 206/321 |
| 3,415,367 | 12/1968 | Lynch | 206/321 |
| 3,732,656 | 5/1973 | Robinsky . | |
| 3,835,620 | 9/1974 | Boltz et al. | 53/157 |
| 3,915,298 | 10/1975 | Adams et al. | 206/321 |
| 4,336,879 | 6/1982 | Carr . | |
| 4,375,848 | 3/1983 | Simpson et al. | 206/321 |
| 4,802,325 | 2/1989 | Duncan . | |
| 5,054,613 | 10/1991 | Johansson . | |
| 5,255,727 | 10/1993 | Saruwatari et al. | 206/321 |
| 5,509,574 | 4/1996 | Lenz et al. | 206/499 |

*Primary Examiner*—Paul T. Sewell
*Assistant Examiner*—Luan K. Bui
*Attorney, Agent, or Firm*—C. Michael Gegenheimer; Robert L. Showalter

[57] ABSTRACT

A package (10, 100) of building-panel products consists essentially of panels (20), panel accessories (30, 32*a–d*, 110*a–d*, 120), and at least one binding means (80, 70*a*, 70*b*), which may include strapping and/or clamping elements. The panels, which are to be mounted to a structure such as a house, are arranged in a stack (20*a*). The accessories, which are to be mounted to the structure in association with the building panels, are positioned to frame one or more sides of the panel stack so as to help maintain the panels in stacked relationship. The binding elements releasably secure the accessories to the stack of building panels to form a cartonless package.

16 Claims, 5 Drawing Sheets

PACKAGE OF BUILDING-PANEL PRODUCTS

TECHNICAL FIELD OF THE INVENTION

The present invention relates to a package system for building-panel products, such as siding panels and accessories. More particularly, my invention relates to a cartonless system for packaging building-panel products.

BACKGROUND OF THE INVENTION

Systems have been developed for packaging various building-panel products. However, known systems suffer from various drawbacks, e.g., they can be expensive, cumbersome, or wasteful. For example, U.S. Pat. No. 4,375,878 to Simpson et al. discloses a package for stacked roof panels requiring support elements.

Siding panels for mounting to houses and like structures, which may be made from vinyl or metal, are typically packaged in cardboard boxes, such as corrugated kraft linerboard boxes. See, e.g., U.S. Pat. No. 3,835,620 to Boltz et al. Accessories, such as J-channels, F-channels, finish trims, corner posts, and starter strips, which are adapted for mounting to houses and like structures in association with the building panels, are likewise packaged in cardboard boxes. Typically, the boxes of building panels and accessories are stacked onto long wooden skids or pallets, framed with wood slats, and wrapped with a polymeric film material.

Other ways of packaging siding panels have been developed, but still suffer disadvantages. For example, U.S. Pat. No. 3,415,367 to Lynch discloses a packaging system employing frame elements and compressible members.

The typical packaging cost as a percentage of the overall cost of building-panel products is quite significant. This is especially true with regard to vinyl siding products. Accordingly, there is a need in the art for a more cost-effective manner for packaging building-panel products.

SUMMARY OF THE INVENTION

An object of the invention is therefore to provide a cost-effective packaging system for building-panel products. Another object of the invention is to provide a cartonless package of building-panel products.

These and other objects are achieved by the present invention, wherein a packaging arrangement or system is provided that employs siding accessories together with binding means, e.g., strapping elements such as elastic bands, polymeric films, fabrics, twine, or string, and/or clamping elements such as clips to maintain building panels in a stack or a bundle. Thus, a package of building-panel products is formed without the need for costly cardboard boxes. Hence, little if any package material disposal is required after product use.

If desired, the invention advantageously permits the use of printed information, such as graphics and/or alphanumeric information, e.g., company names, logos, trademarks, and product information, on surfaces of the outermost building panels in a stack of such panels so that the printed information is clearly visible in the package. Preferably, the back surfaces of the building panels are printed with the information, since they will be facing the building structure when the panels are mounted such that the printed information will not be visible after mounting.

In one general embodiment of the present invention, a package of building-panel products comprises a plurality of building panels, at least one type of panel accessory, and at least one binding element. The building panels, which are adapted to be mounted to a structure such as a house, are arranged in a stack. Each panel accessory, which is adapted to be mounted to the structure in association with the building panels, is positioned in the package system with respect to the building panels to maintain the panels in the stack. Each binding element releasably secures the accessory to the stack to form a package of building-panel products. In a preferred embodiment, a plurality of the panel accessories are employed.

Each building panel may include a central portion and opposing longitudinal edge portions. Each panel further includes a first, exterior surface to be viewed when the panel is mounted to a building structure, and a second, interior surface to be positioned adjacent to the structure when the panel is mounted. In a preferred embodiment, the stack of panels comprises uppermost and lowermost panels that are oriented such that their respective second surfaces are positioned outwardly to define upper and lower surfaces of the package.

Optionally, the uppermost and/or lowermost panel may bear printed information on its second surface, which is visible in the package. The information may be printed directly onto the upper and/or lower panels; alternatively, labels and the like having printed information thereon may be applied to the second surface of the upper and/or lower panels. The information may comprise information normally found on packaging boxes typically used for packaging building panels and associated accessories.

The building panels may be stacked such that successive panels are inverted relative to one another. The building panels may be provided with formed longitudinal edge portions and stacked such that two adjacent panels in the stack have nested edge portions.

In one preferred embodiment, two pairs of a first type of panel accessories are provided. The first and second accessory components are positioned adjacent to one another such that they define a first pocket for receiving a first outer edge of the stack of panels. The third and fourth panel accessory components are positioned adjacent to one another such that they define a second pocket for receiving a second outer edge of the stack of panels. One or more first securement clips may be provided for clamping together edge sections of the first and second panel accessories, and one or more second securement clips may be provided for clamping together edge sections of the third and fourth panel accessories. Additionally, a second type of accessory may be provided and positioned between one or more of the first type of panel accessories and an outer edge of the stack.

Thus, the present invention provides a packaging arrangement advantageously utilizing accessories together with binding members to maintain building panels in a stack such that little if any packaging disposal is required after product use. The invention also advantageously provides an economical method for packaging building panels and associated accessories.

The above-discussed and other objects and advantages of the present invention will become apparent from the following detailed description in conjunction with the accompanying drawings, in which like numerals refer to like elements.

DETAILED DESCRIPTION AND PREFERRED EMBODIMENTS OF THE INVENTION

Figure 1:
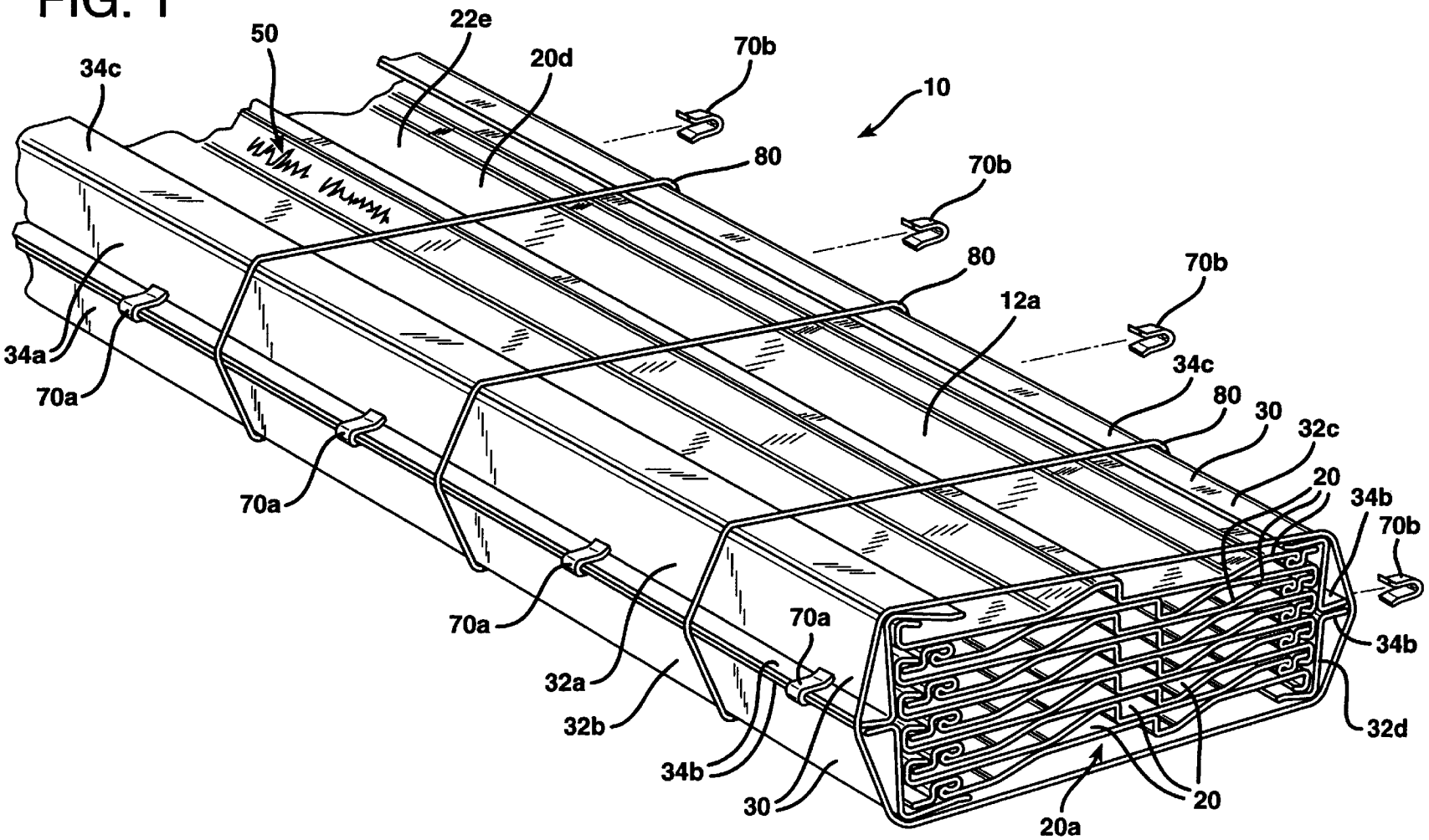
FIG. 1 is a perspective view of a package of building-panel products constructed in accordance with a preferred embodiment of the present invention.
Figure 2:
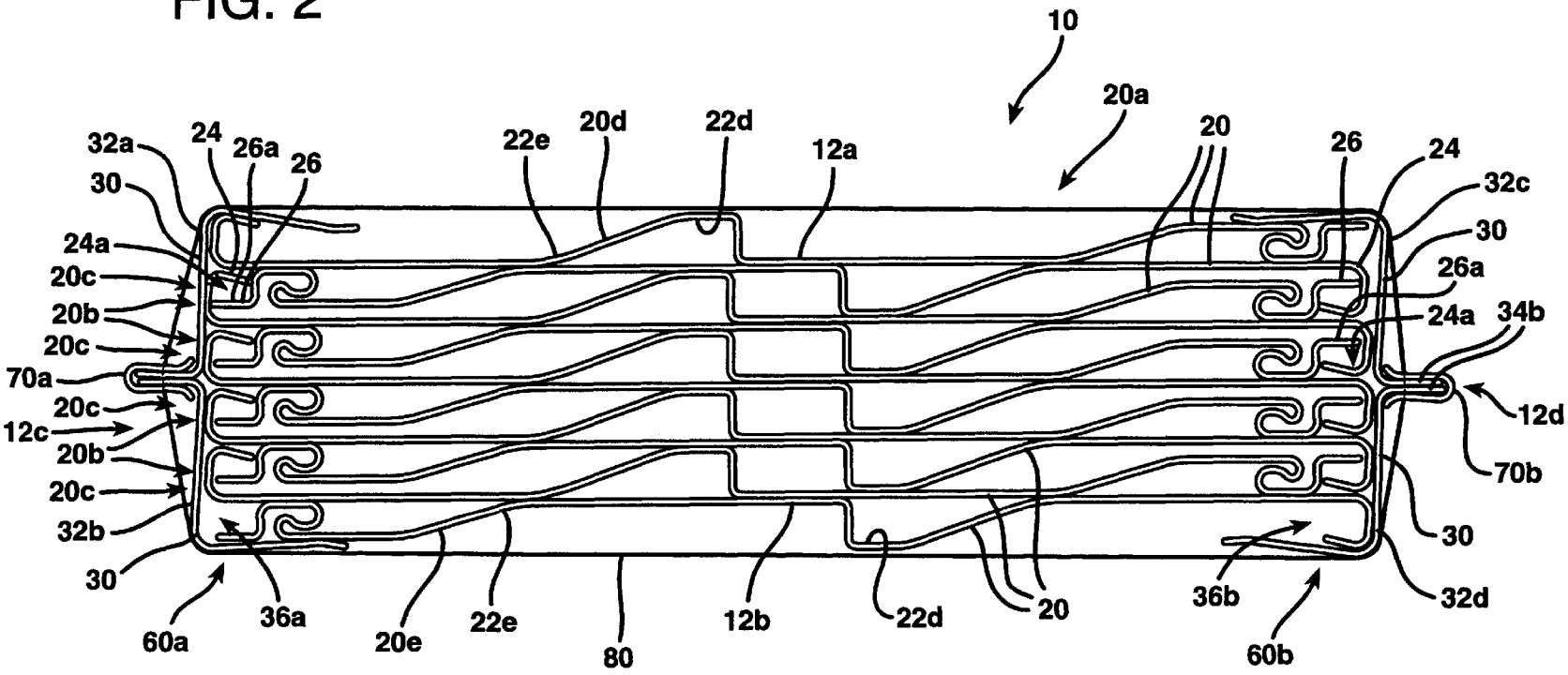
FIG. 2 is an end view of the package system shown in FIG. 1.

A package 10 of building-panel products in accordance with a preferred embodiment of the present invention is shown in FIGS. 1 and 2. The package 10 comprises building panels 20, which may be, e.g., siding panels adapted to be mounted in a conventional manner to a building structure, such as a house. Although in a preferred embodiment the panels 20 are siding made from a vinyl material, the panels may be of another type and formed from another polymeric material or a metal material, such as aluminum. The package 10 also comprises panel accessories 30, which are adapted to be mounted in a conventional manner to the structure in association with the building panels 20. The accessories 30 are positioned with respect to the panels 20 so as to help maintain the panels 20 in a stack 20*a*. Additionally, the package includes binding or securing elements 40, which releasably secure the panel accessories 30 to one another and/or in the stack 20*a*.

Figure 3:
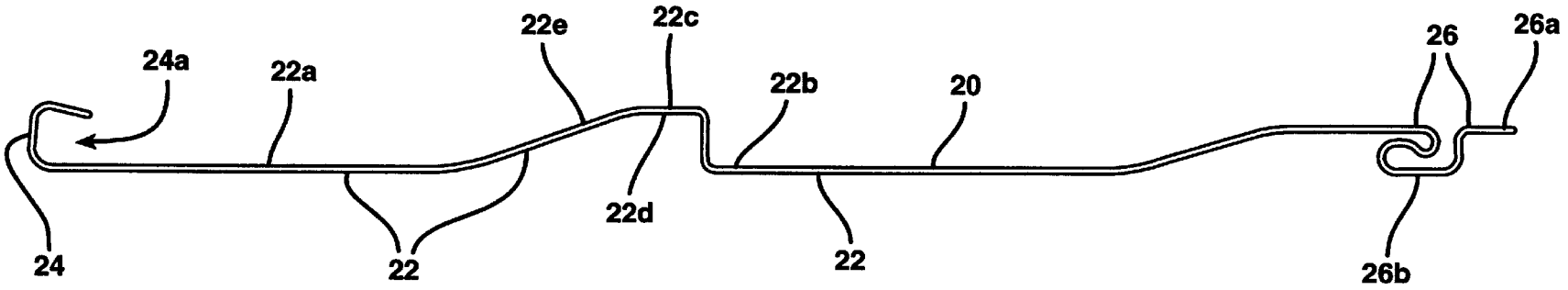
FIG. 3 is an end view of one of the building panels shown in FIG. 1.
Figure 4:
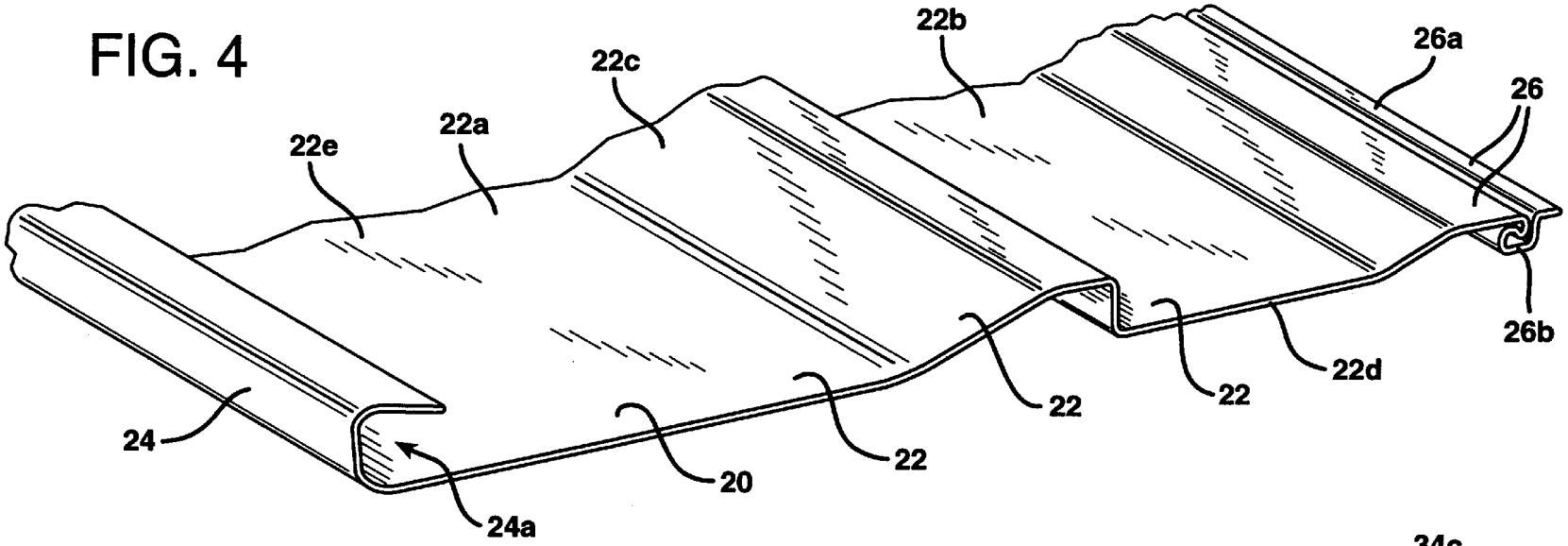
FIG. 4 is a perspective view of a portion of one of the building panels shown in FIG. 1.

In the illustrated embodiment, each of the panels 20 comprises a central portion 22 and first and second longitudinal edge portions 24 and 26 (see FIG. 3). The central portion 22 has first and second generally flat sections 22*a* and 22*b*, and a centrally located projecting section 22*c* interposed between sections 22*a* and 22*b*. Each panel 20 further includes a first surface 22*d*, which is to be viewed when the panel 20 is mounted to the structure, and a second surface 22*e*, which is to be positioned facing the walls of the structure such that it cannot be seen when viewing the structure. The first edge portion 24 is C-shaped so as to define a receiving recess or channel 24*a*. The second edge portion 26 is formed having a substantially flat end section 26*a* and a bead section 26*b* interposed between the end section 26*a* and the second section 22*b* of the central portion 22.

Panel pairs 20*c* are formed by inverting two inner-package panels 20*b* relative to one another such that their edge portions 24 and 26 are nested, with each recess 24*a* receiving the flat section 26*a* of an adjacent, associated panel 20 (see FIG. 2). Upper and lower panels 20*d* and 20*e* in the stack 20*a* are oriented such that their respective second surfaces 22*e* are positioned outwardly to define upper and lower surfaces 12*a* and 12*b* of the package 10. The second surfaces 22*e* of the upper and lower panels 20*d* and 20*e* help keep the first surfaces 22*d* of all of the panels 20 in the package 10 clean during transit and storage.

In the illustrated embodiment, the upper panel 20*d* is provided with information 50 printed directly on its second surface 22*e*, which is visible when viewing the package 10. The information may comprise information normally found on cardboard packaging boxes in which building panels and associated accessories are typically packaged. Such information may comprise graphics and/or alphanumeric information, such as company names, trademarks, and product information. Because the information 50 is provided on the second surface 22*e* of the upper panel 20*d*, the information 50 will not be visible once the panel 20*d* is mounted or affixed to a building structure. Optionally, information may alternatively or additionally be provided on the second surface 22*e* of the lower panel 20*e*. Also, labels and the like having printed information thereon may additionally or alternatively be applied to one or both of the second surfaces 22*e* of the upper and lower panels 20*d* and 20*e*. A conventional paper-transfer technique or any other suitable method may be used to apply such labels to the building panels 20*d* and 20*e*, e.g., just after they are extruded and in-line with the extruder.

In the package 10, the panel accessories 30 are positioned with respect to the building panels 20 so as to help maintain the panels 20 in a stacked relationship. Once the package 10 has been delivered to the location of a structure to which siding products are to be mounted, the package 10 may be disassembled and the panel accessories 30 may be secured in a conventional manner to the structure in association with the building panels 20. Thus, the panel accessories 30 perform dual functions: (i) they form part of the packaging material, maintaining the building panels 20 in a bundled or a stacked relationship for shipping and storage purposes; (ii) they form part of the building-panel products and, after the package 10 has been delivered to the location of the structure to which the panels 20 are to be mounted, may be mounted to the structure together with the panels 20, e.g., as part of the siding layer mounted to the structure.

Figure 5:
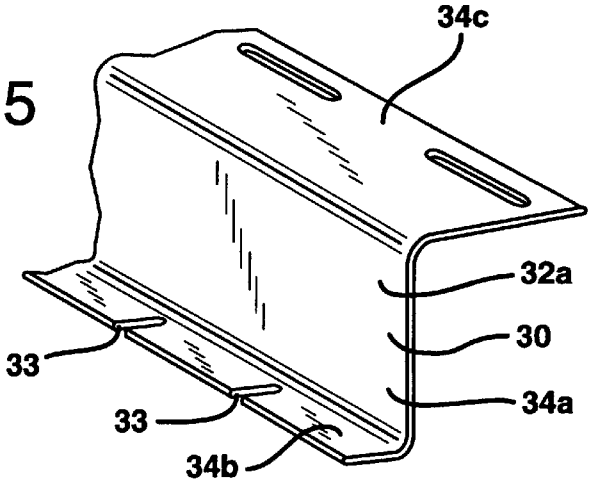
FIG. 5 is a perspective view of a portion of one of the panel accessories shown in FIG. 1.

In the embodiment illustrated in FIGS. 1, 2, and 5, the panel accessories 30 include four drip edges: first, second, third, and fourth drip edges 32*a*-32*d*. The drip edges 32*a*-32*d* each has a central section 34a and first and second transverse edge sections 34*b* and 34*c* (see FIG. 5). The first and second drip edges 32*a* and 32*b* are oriented relative to one another such that their respective first edge sections 34*b* abut one another (see FIG. 1). As so oriented, the pair of drip edges 32*a* and 32*b* define a first pocket 36*a* for receiving a first outer edge 60*a* of the stack 20*a* (see FIG. 2). The third and fourth drip edges 32*c* and 32*d* are likewise oriented relative to one another such that their respective first edge sections 34*b* abut one another, defining a second pocket 36*b* for receiving a second outer edge 60*b* of the stack 20*a* opposite the first outer edge 60*a*.

First securement clips 70*a* are provided for frictionally engaging the abutting first edge sections 34*b* of the first and second drip edges 32*a* and 32*b*, thereby clamping together the first and second drip edges 32*a* and 32*b*. Second securement clips 70*b* are also provided for clamping together the first edge sections 34*b* of the third and fourth drip edges 32*c* and 32*d*. The clamped first and second drip edges 32*a* and 32*b* define a first side 12*c* of the package 10 and the clamped third and fourth drip edges 32*c* and 32*d* define a second side 12*d* of the package 10 (see FIG. 2). In the illustrated embodiment, elastic bands 80 are also wrapped around the building panels 20 and the drip edges 32*a*-32*d*, securing the building panels 20 and the drip edges 32*a*-32*d* together in the package 10. The drip edges 32*a*-32*d* may be provided with receiving notches 33 (shown in FIG. 5) for positioning the bands 80.

In alternative embodiments, other suitable binding or securing means, such as twine, non-elastomeric polymeric films, or bands for strapping, or other types of clips for clamping, may be used in place of the illustrated elastic bands 80 and/or clips 70*a* and 70*b*. For example, the binding elements may be advantageously formed from a readily recyclable material, such as high-density polyethylene (HDPE), or from a biodegradable material, such as starch-extended polymers. Additionally, the binding elements may be employed for another utility after the package 10 has been disassembled—e.g., polymeric films may be later used as a geotextile or geomembrane, e.g., a landscaping fabric or lining.

The style of the illustrated building panel 20 is commonly known in the industry as dutchlap. Other styles, shapes, or cross-sectional profiles of building panels may be used, such as double and triple siding panels, soffit and fascia panels, and vinyl skirting. The panels may be solid or perforated (e.g., for ventilation), and may include nailing strips. The panels may have suitable dimensions, e.g., standard dimensions or custom-cut dimensions. For example, siding panels may measure approximately 12 feet (3.7 m) in length by 11 inches (28 cm) in width by 1/16 inch (1.6 mm) in thickness. A package may contain a convenient number of panels, such as about six to twenty panels, more preferably about eight to sixteen panels. For instance, one or two packages may contain building-panel products adequate to cover about 200 square feet (18.6 $m^2$) of building area.

The panel accessories may comprise other conventional accessories, such as F-receivers, J-channels, corner posts, starter strips, utility trim, undersill trim, soffit double-channel lineals, soffit snap-in covers, and the like. Further, although in a preferred embodiment the panel accessories 30 extend along the entire length or side of the package 10, this is not necessary to maintain the panels 20 in a stack 20a.

The ratio of the number of accessory components to the number of building panels in a package is preferably about the same as the ratio of accessories to building panels necessary to complete a desired siding layer on the structure to which the siding products are to be mounted. Also, different packages containing varying accessories may be custom-palletized so that a pallet of packages will contain sufficient building-panel products for the desired job. For example, a pallet may include packages 10 of siding panels bordered by drip-edge accessories as shown in FIGS. 1–5 as well as packages 100 of siding panels bordered by J-channel and trim accessories as shown in FIG. 6.

Figure 6:
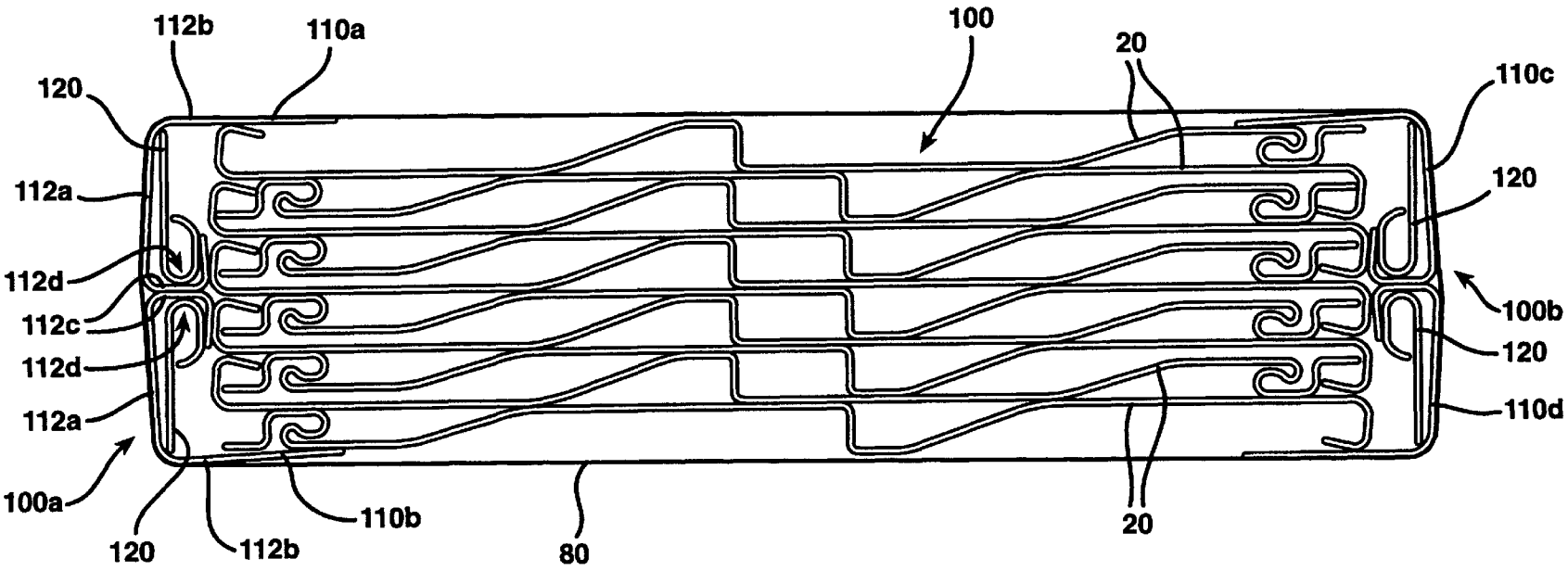
FIG. 6 is an end view of a package of building panel-products constructed in accordance with another preferred embodiment of the invention.

In the preferred embodiment of a package 100 shown in FIG. 6, the building panels 20 are of the same style as those illustrated in FIGS. 1–4. The accessories in this embodiment, however, include two types of accessories. The first or primary accessory components comprise J-channels 110*a*-110*d*. The J-channels 110*a*-110*d* have a central section 112*a*, a substantially flat end section 112*b*, and a C-shaped end section 112*c*, which defines a receiving recess 112*d*. First and second J-channels 110*a* and 110*b* are positioned relative to one another such that the pair defines a first side 100*a* of the package 100, and third and fourth J-channels 110*c* and 110*d* are positioned relative to one another such that the pair defines a second side 100*b* of the package 100. Also included within the package 100 are second or secondary accessory components 120, which are finish trims in the illustrated embodiment. The finish trims 120 are received within the recesses 112*d*. The secondary accessories 120 are adapted to be mounted to the structure in association with the panels 20 and the J-channels 110*a*-110*d*. The secondary accessories 120 may comprise other conventional siding accessories, such as F-channels, corner posts, starter strips, and the like. Elastic bands 80 are preferably wrapped about the J-channels 110*a*-110*d*, the building panels 20, and the finish trims 120 so as to maintain those products in a convenient package 100.

Having described the invention in detail and by reference to preferred embodiments, various modifications within the spirit of the invention will become apparent to artisans. Accordingly, the invention is intended not to be limited by the foregoing description, but to be defined by the appended claims and their equivalents.

What is claimed is:

1. A package of building-panel products comprising:

a stack of building panels to be mounted to a building structure including an uppermost building panel, a lowermost building panel, and at least one pair of adjacent building panels inverted relative to one another between said uppermost building panel and said lowermost building panel, each of said building panels including first and second longitudinal edge portions and a central portion therebetween, and wherein in each of said building panels, the first longitudinal edge portion curves toward the central portion to define a recess, and in said pair of adjacent building panels, the second longitudinal edge portion of one of said adjacent panels is received well within the first longitudinal edge portion recess of the other of said adjacent panels so as to be in contact or substantially in contact with said first edge portion;

primary panel accessories to be mounted to said structure in association with said building panels and positioned to maintain said building panels in the stack; and at least one binding element releasably securing said primary panel accessories to said stack of building panels.

2. A package as set forth in claim 1, wherein said at least one binding element comprises a strapping element extending around said stack of building panels and said primary panel accessories, the strapping element being selected from the group consisting of elastic bands, twine, string, and polymeric films.

3. A package as set forth in claim 1, further comprising secondary panel accessories, said primary and secondary panel accessories being selected from the group consisting of drip edges, channels, receivers, corner posts, starter strips, trims, and lineals.

4. A package as set forth in claim 1, wherein said primary panel accessories include: a first pair of drip edges clamped together around a first side of the stack of building panels; and a second pair of drip edges clamped together around a second side of the stack of building panels.

5. A package of building-panel products comprising:

a stack of building panels to be mounted to a building structure including an uppermost building panel, a lowermost building panel, and one pair of adjacent building panels inverted relative to one another between said uppermost building panel and said lowermost building panel, each of said building panels including first and second longitudinal edge portions, and wherein the second edge portion of one of said pair of adjacent panels is received well within a recess of the first edge portion of the other of said pair of adjacent panels so as to be in contact or substantially in contact with said first edge portion;

panel accessories comprising primary accessories to be mounted to said structure in association with said building panels and positioned to maintain said building panels in the stack; and at least one binding element releasably securing said stack of building panels and said panel accessories together.

6. A package as set forth in claim 5, wherein each of said building panels further comprises a central portion between said first and second longitudinal edge portions, a first surface to be viewed when said panel is mounted to the structure, and a second surface to be positioned facing the structure when the building panel is mounted thereto.

7. A package as set forth in claim 6, wherein said uppermost and lowermost panels are oriented such that their respective second surfaces are positioned outwardly to define upper and lower surfaces of the package, and at least one of said uppermost and lowermost panels has printed information on the second surface thereof.

8. A package as set forth in claim 5, wherein said at least one binding element includes at least one member selected from the group consisting of strapping elements and clamping elements.

9. A package as set forth in claim 5, wherein said primary panel accessories include a first pair of accessory components having facing edge sections and defining a first pocket receiving one set of the nested first and second longitudinal edge portions of the stack of building panels.

10. A package as set forth in claim 9, wherein said at least one binding element comprises: at least one securement clip clamping together said facing edge sections of each said pair of accessory components; and at least one elastic band extending around said stack of building panels and said panel accessories.

11. A package as set forth in claim 10, wherein said primary panel accessories further include a second pair of accessory components having facing edge sections and defining a second pocket receiving the other set of the nested first and second longitudinal edge portions of the stack of building panels.

12. A package as set forth in claim 11 wherein said panel accessories further comprise secondary accessories positioned between at least one said pair of accessory components and an adjacent set of the nested first and second longitudinal edge portions of the stack.

13. A package as set forth in claim 12, wherein said at least one binding element further comprises at least one securement clip clamping together said facing edge sections of said second pair of accessory components.

14. A package as set forth in claim 13, wherein said building panels are siding panels having a dutchlap shape.

15. A package as set forth in claim 5, wherein said building panels are polymeric siding panels, and said at least one binding element comprises a strapping element extending around said stack of building panels and said panel accessories.

16. A package of building-panel products comprising:

a stack of building panels to be mounted to a building structure including an uppermost building panel, a lowermost building panel, and at least one pair of adjacent building panels inverted relative to one another between said uppermost building panel and said lowermost building panel, each of said building panels comprising first and second longitudinal edge portions, and a central portion between said first and second longitudinal edge portions;

panel accessories comprising primary accessories to be mounted to said structure in association with said building panels and positioned to maintain said building panels in the stack, said primary panel accessories including a first pair of accessory components having facing edge sections and defining a first pocket receiving one set of the first and second longitudinal edge portions of the pair of adjacent building panels; and at least one binding element releasably securing said stack of building panels and said panel accessories together, said at least one binding element comprises: at least one securement clip clamping together said facing edge sections of said pair of accessory components; and at least one elastic band extending around said stack of building panels and said panel accessories.

* * * * *